United States Patent [19]

Pasquini

[11] 4,218,978

[45] Aug. 26, 1980

[54] APPARATUS FOR TAMPING OR PACKING THE BED OF RAILWAY TRACKS

[75] Inventor: Sandro Pasquini, Latour-de-Peilz, Switzerland

[73] Assignee: Matisa Materiel Industriel S.A., Lausanne, Switzerland

[21] Appl. No.: 873,532

[22] Filed: Jan. 30, 1978

[30] Foreign Application Priority Data

Feb. 18, 1977 [CH] Switzerland ..... 2027/77

[51] Int. Cl.[2] ..... E01B 27/16

[52] U.S. Cl. ..... 104/12; 104/10

[58] Field of Search ..... 104/12, 7 R, 7 B, 10

[56] References Cited

U.S. PATENT DOCUMENTS

| | | | |
|---|---|---|---|
| 2,096,724 | 7/1963 | Kershaw | 104/12 |
| 2,926,617 | 3/1960 | Kershaw | 104/12 |
| 3,016,023 | 1/1962 | Plasser et al. | 104/12 |
| 3,625,156 | 12/1971 | Anderson | 104/12 |
| 3,675,581 | 7/1972 | Plasser et al. | 104/12 |
| 3,714,901 | 2/1973 | Stewart | 104/12 |

FOREIGN PATENT DOCUMENTS

| | | | |
|---|---|---|---|
| 601969 | 2/1960 | Italy | 104/12 |
| 315255 | 9/1956 | Switzerland | 104/12 |

*Primary Examiner*—Randolph A. Reese
*Attorney, Agent, or Firm*—Wenderoth, Lind & Ponack

[57] ABSTRACT

Apparatus for tamping the bed of a railway track comprises a wheel mounted tamping machine frame on which is mounted a vertically displaceable support for tamping tools. The tools are mounted on the tool support in opposed pairs and each tool comprises an arm having at least one pick extending therefrom and provided at its lower end with a blade. A motor driven crank-shaft is journalled in a bearing rigidly connected to the tool support and includes eccentric bearings on each of which the arm of a tamping tool is pivoted by its end remote from the blade so as to impart vibratory oscillations to the tool. So that substantially only generally horizontal vibratory oscillations are transmitted to the blade, the arms of the tools are formed of a generally squarely elbowed configuration, and are each connected to the tool support by a double-acting piston cylinder. The piston cylinder extends in a nearly vertical direction and is pivoted at one end to the tool in the region of the elbow of the arm of the tool and at its other end, to the tool support. The piston cylinder provides pivotal movements of the arm about the crank-shaft to squeeze the ballast beneath a tie.

1 Claim, 2 Drawing Figures

APPARATUS FOR TAMPING OR PACKING THE BED OF RAILWAY TRACKS

BACKGROUND OF THE INVENTION

The present invention relates to apparatus for tamping or packing the bed of railway tracks of the type comprising a mobile chassis or frame having wheels for rolling on the track rails, at least one support for packing, or tamping, tools vertically displaceable with respect to the frame, at least two packing tools oppositely mounted on the said tool support and each constituted by an arm having at least one pick extending therefrom and provided with an end plate or blade, at least one rotary eccentric or crank-shaft to be driven by a motor journalled in a bearing rigidly connected to the tool support and comprising eccentric bearings on each of which the arm of a packing tool is pivoted by its end remote from the pick so as to impart vibratory oscillations to the said tool, and extensible connection means connecting said arm with the tool support and adapted to effect pivoting of the arm about its pivot.

Similar packing apparatus are known in which the two packing tools, which are substantially rectilinear in configuration and disposed vertically, are pivoted about a rotary crank-shaft to draw one and the other together in the ballast with their pick blades on both sides of a sleeper, or tie, by means of jacks disposed in a generally horizontal position and pivoted at their ends on the one hand to the tool support and on the other hand to the tools at a point on their arms situated generally at the mid-point between their pivot on the crank-shaft and the blade of their pick.

Such packing apparatus are robust and economic by their simplicity of construction but the vibratory oscillations transmitted to the pick stops of the tools similarly pivotally mounted on their pivot points with a horizontal jack connected to the tool support, have a somewhat circular trajectory, the radius of which is proportional to the eccentricity of the off-center bearings of the rotatable shaft.

This circular trajectory of the vibratory oscillations of the pick blades is not desirable, it having been found that the best ballast compacting results are obtained with vibratory oscillations having generally horizontal trajectories or having at the most a very flattened curvilinear form the major axis of which is tangential to the pivotal trajectory of the blade about the crank-shaft on which the tool which carries it is pivoted.

This is why this kind of direct connection of the packing tools with rotary crank shaft turning in a bearing rigidly connected to the tool support has been generally replaced, despite its advantages of simplicity, of robustness and of economy, by more complex packing devices.

There is cited by way of example and without dwelling thereon, as such are not the type to which this invention relates, but rather for interest to explain the ballast compacting effect obtained by the horizontal vibratory oscillations of the packing blades, in the best known packing apparatus the desired effect is obtained in practice, in a relatively complex manner by vertical immobilization of the pivot point of the tools and the inter-position of a connecting rod between the crank-shaft and the upper ends of the tools.

Similarly there are mentioned packing apparatus which have been proposed to obtain this same desired horizontal displacement effect without the inter-position of connecting rods between the tools and the crank-shaft but such have never passed the prototype stage due to their complexity.

Likewise there have been proposed packing apparatus in which each tool and rotatable crank-shaft which transmits vibratory oscillations thereto together form a mechanical unit pivoting around a pivotal axis situated between its two ends and integral with the tool support; the upper end of the said tool being connected to the tool support by a jack adapted to provoke its pivoting around the said axis. In these packing apparatus each tool comprises a gear box pivotable on the pivotal axis integral with the tool support and comprising an upward extension provided for its connection with the jack and in which is housed the crank-shaft, similarly, a fork has a vertically sliding bearing housed between the prongs of the fork and pivoted on the off-center part of the crank-shaft; this fork being angularly connected by rigid attachment to another rotary shaft carried by the said gear box which is rigidly connected, on the outside, the lower part of the packing tool. This construction in which only the horizontal vibratory oscillations are transmitted by the rotatable crank-shaft to the fork integral with the lower part of the tool carrying the packing blade is, it goes without saying, relatively complex and fragile due to the fact of the numerous parts functionally integral one with the other constituting each packing tool.

It has also been proposed, but to another end, to actuate the jack to provoke the pivoting of the packing tools to the point where the member which establishes the connection between the said tools and the crank-shaft is pivoted to the said tools or operates on these. In such packing apparatus the crank-shaft no longer turns in a bearing rigidly fixed on the tool support but is rather suspended on the rod of a jack adapted to pivot the tools and connected to the said tool support either by pivoting or by rigid attachments. In the first case the tools are elbowed and themselves suspended by their elbows from the tool support by the intermediary of a resilient connection in the horizontal direction. In the second case the tools are similarly elbowed but each conforms in two telescopic parts one of which is connected to the crank-shaft and the other is pivoted by its elbow to a pivot integral with the tool support. These two proposals result in a movement, not explicitly sought wherein the stops of the packing tools effect generally horizontal vibratory oscillations. The suspension of the vibrator comprises a bearing and a crank-shaft and its motor at the end of the rod of the jack is delicate and fragile, and the necessity of permitting the free pivotal play of the tools in making these extensible by a telescopic system or, alternatively, in connecting them to the tool support by elastic suspensions is complex, is not rational and again increases the fragility of this system of connection between the packing tools and the tool support.

Examples of patents illustrating prior developments are: Japanese Pat. No. 35-12706 of May 1958; U.S. Pat. Nos. 3,016,023 of Jan. 9, 1962; 3,669,025 of June 13, 1972; 3,998,165 of Dec. 21, 1976; Austrian Pat. No. 206,915 of May 28, 1958.

It is an object of the present invention to provide with simple packing apparatus of the type cited at the beginning of this specification in which the packing tools are directly connected to a rotary eccentric or crank-shaft turning in a bearing rigidly fixed to a tool support, substantially horizontal vibratory oscillations.

SUMMARY OF THE INVENTION

According to the present invention there is provided apparatus for compacting the bed of a railway track comprising a mobile frame for rolling displacement along the track, at least one support for packing tools on and vertically displaceable with respect to the frame, at least two packing tools oppositely mounted on said tool support and each comprising an arm having at least one pick extending therefrom and provided with an end blade, at least one motor driven rotary eccentric shaft, or crank-shaft, journalled in a bearing rigidly connected to the tool support and comprising eccentric bearings on each of which the arm of a packing tool is pivoted by its end distal from the pick so as to impart vibratory oscillations to the said tool, and extendable connection means connecting the arm with the tool support and adapted to affect pivotal movements of the arm about the pivot point characterized in that, with the object of transmitting only generally horizontal vibratory oscillations to the pick blades, the arms of the tools have a known generally squarely elbowed configuration, and in that the extendable connection means comprises a double-acting piston cylinder extending in a nearly vertical direction and pivoted at one end in the region of the elbow of the arm of a tool and at its other end to the tool support.

DESCRIPTION OF THE DRAWINGS

The following is a description by way of example of one embodiment of the present invention, reference being had to the accompanying drawings, in which.

DESCRIPTION OF THE PREFERRED EMBODIMENT

Figure 2:
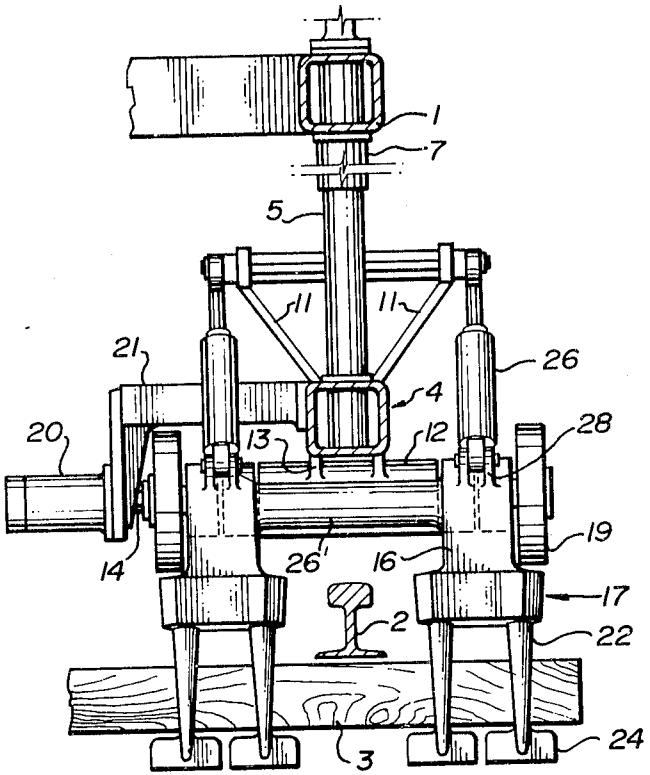
FIG. 2 is an elevation of the apparatus viewed in the direction of extension of the track from the left-hand side of FIG. 1.

A tamping or packing apparatus is shown comprising a mobile chassis or frame 1 of a tamping machine of which only a part thereof is considered necessary to illustrate to provide a proper understanding of the apparatus. The frame 1 is rollingly displaceable along a railroad track of which a rail 2 and a sleeper or tie 3 are shown.

A vertically displaceable packing or tamping tool support 4 is suspended from frame 1 and includes two vertical columns 5 and 6 which are rigidly connected to support 4 and vertically slidable in two bearings 7 and 8 rigidly connected to the frame 1.

The raising and lowering of the support 4 is controlled by a hydraulic jack 9 having the end of its piston rod pivotally connected in a bearing 10 integral with a vertical extension 11 of the tool support 4 and the body of which extends across the frame 1. The jack 9 is fixed at its other end to the frame 1. The piston rod and cylinder of the hydraulic jack 9 and the two bearings 7 and 8 are shown fragmented so that such do not extend beyond the frame of the drawing; these members having a length which is sufficient to permit the raising and disengagement of the packing tools above the level of the rail 2.

The packing tool support 4 has a bearing 12 at its lower end, as is clearly shown in FIG. 2, which bearing is rigidly connected to support 4 by the intermediary of welded connecting feet 13 and extends transversally above the rail 2.

Figure 1:
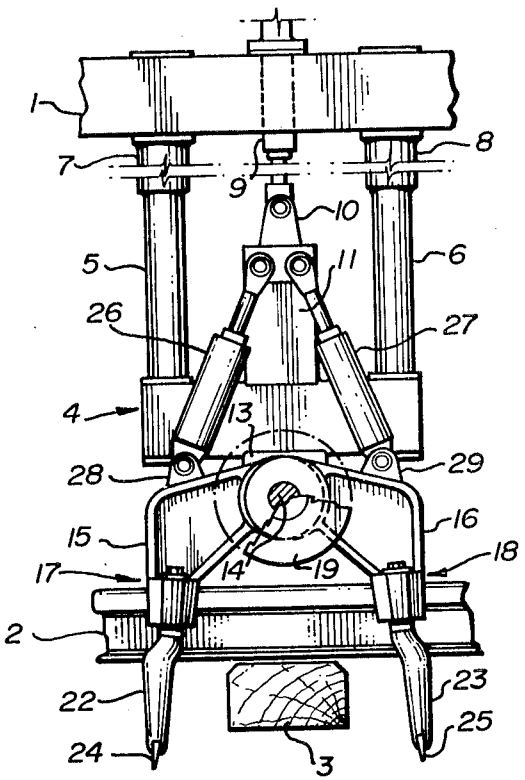
FIG. 1 is a fragmentary elevation of a portion of a tamping or packing apparatus viewed from the side of the railway track.

An eccentric or crank-shaft 14 is rotatable in bearing 12 as seen in section in FIG. 1. The ends of the crank-shaft 14 overhang the bearing 12 and each end comprises two adjacent eccentric bearings on which are pivoted the upper ends of two generally square elbowed arms 15 and 16 for two oppositely mounted packing tools 17 and 18, as well as an inertia fly-wheel 19.

Towards the inside of the track, to the left of FIG. 2, the shaft 14 is connected to a hydraulic motor 20 adapted to impart thereto a rapid rotational movement. The motor 20 is secured to the tool support 4 by a bracket 21.

The arms 15 and 16 of the two packing tools 17 and 18 are extended downwardly by picks 22 and 23 provided with end plates or blades 24 and 25, two picks for each tool arm have been illustrated in the embodiment. The two tool arms 15 one on each side of the bearing 12, are here connected by a cross member 26' but this connection is not indispensible. This is also true for the arms 16.

The pivoting of the tamping tools 17 and 18 about their pivots on the eccentric bearings of the shaft 14, to bring the blades 24 and 25, spanning the sleeper 5, towards each other in the ballast and move them apart is controlled by double-acting hydraulic jacks 26 and 27. These jacks are extendable in a nearly vertical direction and each connects one packing tool to the tool support 4 in the following manner. The body of each of the hydraulic jacks 26 and 27 is pivoted respectively to ears 28 and 29 integral with the arms 15 and 16 of the packing tools 17 and 18. Each said ear is in the form of a clevis situated in the region of the elbow of the tools, and the rod of each of these hydraulic jacks is pivoted to the vertical extension 11 of the tool support 4 which is constituted by an assembly of welded plates, as shown in FIG. 2, which are in the form of a trapezium the smaller side of which is integral with the middle part of the tool support 4 and the major side of which carries at its ends the pivots to which the rods of the hydraulic jacks 26 and 27 are pivoted.

The arrangement of the jacks 26 and 27 with respect to the tools can obviously be reversed but the arrangement described permits a rapid opening of the tools and the application of effective force for the ballast compaction by drawing together of the blades 24, 25 and likewise, great resistance to impact during the insertion of the tools into the ballast.

The packing apparatus described and illustrated effectively permits substantially only the transmission of horizontal vibratory oscillations to the pick blades of the packing tools and achieves this in an advantageous manner because of its simplicity and its robustness.

Thus, each packing tool, for example the tool 17, is vebrated by the rotation of the eccentric bearing of the shaft 14 to which it is pivoted. At this level, the trajectory of the vibratory oscillations of the arm 15 of this tool is circular. At the level of the pivot 28 of the arm with the jack 26, the oscillations transmitted can no longer extend vertically because this pivot is integral with the vertically immobilised jack, but only extend on the arc of a large radius circle having for its center the pivot of jack 26 with the tool support 4 and on a very small generally horizontal portion of this arc. As the distance between the pivot 28 of this jack on the arm 15 and the stop 24 of this tool 17 is fixed it can be considered that the stop 24 can only oscillate on a trajectory in a generally horizontal portion of an arc of a circle having for its center the said pivot 28. In reality this trajectory is curvilinear but is very flattened and its major axis is generally tangential to the portion of the arc of the circle due to the fact of the combined displacements of the arm of this tool 17 simultaneously about the eccentric of the shaft 14 to which it is pivoted and on the arc described by its pivot 28 connected to the jack 26.

Depending on their size, it can be advantageous to limit the effects of the vertical vibratory oscillations of the packing tools 17 and 18 locked by the jacks 26 and 27, effects which are transmitted by the intermediary of the tool support 4 and of its control jack 9 to the frame 1.

To this end, the center of mass of the inertia fly-wheel 19 can be displaced with respect to the axis of rotation of crank shaft 14 in the direction of the plane of the bisection of the dihedral formed by the two planes joining the said axis of rotation to the two axes of revolution of the eccentric bearings; the effect of this eccentricity of the mass of the fly-wheel 19 naturally being calculated so as to compensate all or very nearly all the effects of the vertical oscillations transmitted to the frame 1. That is to say the mass of the fly-wheel is positioned so as to offset the unbalanced component created by the rotation of the tool arm ends about the eccentric shaft.

Variations and modifications may be effected to thedescribed embodiment of the packing tool without departing from the scope of the present invention.

Similarly, the number of picks per tool can be varied and be limited to a unit; the groups of two oppositely mounted tools on the tool support could be mounted not on a common crank shaft, as described, but each tool of each group mounted on its own crank shaft.

Finally, the packing apparatus itself may be used conjointly with other railway treatment and maintenance apparatus on the same rolling support frame similary in conjunction with track measuring or analysing apparatus.

What is claimed is:

1. An apparatus for compacting the bed of a railroad track which apparatus includes a mobile frame for movement along the track, at least one support for tamping tools mounted for vertical displacement on the frame, at least two tamping tools oppositely mounted on said tool support and each comprising an arm having at least one pick extending therefrom and provided with an end blade disposed substantially in a vertical plane, at least one motor driven rotary eccentric shaft, journalled in a bearing rigidly connected to the tool support and comprising eccentric bearings on each of which the arm of a tamping tool is pivoted by its end distal from the pick to impart vibratory oscillations to said tool, the arms of each tool having a generally squared elbowed configuration and a double-acting piston cylinder extending in a substantially vertical direction and pivoted at one end in the region of the elbow of the arm of the tool at a point above the eccentric shaft and at its other end to the tool support to effect pivotal movements of the arm about the bearing whereby to transmit only generally horizontal vibratory oscillations to the tool blades.

* * * * *